US007278490B2

(12) United States Patent
McGuire et al.

(10) Patent No.: US 7,278,490 B2
(45) Date of Patent: Oct. 9, 2007

(54) BLAST JOINT SWIVEL FOR WELLHEAD ISOLATION TOOL AND METHOD OF USING SAME

(75) Inventors: Bob McGuire, Oklahoma City, OK (US); L. Murray Dallas, Fairview, TX (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 264 days.

(21) Appl. No.: 11/025,453

(22) Filed: Dec. 28, 2004

(65) Prior Publication Data

US 2006/0137882 A1 Jun. 29, 2006

(51) Int. Cl.
*E21B 19/16* (2006.01)
*E21B 33/04* (2006.01)

(52) U.S. Cl. ..... 166/379; 166/382; 166/85.1; 166/75.14; 166/75.13

(58) Field of Classification Search ..... 166/379, 166/382, 85.1, 85.4, 85.5, 90.1, 92.1, 94.1, 166/75.13, 75.14
See application file for complete search history.

(56) References Cited

U.S. PATENT DOCUMENTS

| | | | | | |
|---|---|---|---|---|---|
| 2,660,248 | A * | 11/1953 | Brown | 166/78.1 |
| 4,915,177 | A * | 4/1990 | Claycomb | 166/380 |
| 5,012,865 | A * | 5/1991 | McLeod | 166/90.1 |
| 5,275,441 | A * | 1/1994 | Claycomb | 285/45 |
| 5,540,282 | A | 7/1996 | Dallas | 166/379 |
| 5,785,121 | A * | 7/1998 | Dallas | 166/90.1 |
| 5,819,851 | A | 10/1998 | Dallas | 166/308 |
| 5,957,198 | A | 9/1999 | Haynes | 166/250.03 |
| 6,019,175 | A * | 2/2000 | Haynes | 166/382 |
| 6,220,363 | B1 | 4/2001 | Dallas | 166/382 |
| 6,289,993 | B1 | 9/2001 | Dallas | 166/386 |
| 6,364,024 | B1 * | 4/2002 | Dallas | 166/379 |
| 6,447,021 | B1 | 9/2002 | Haynes | 285/302 |
| 6,626,245 | B1 * | 9/2003 | Dallas | 166/379 |
| 6,712,147 | B2 * | 3/2004 | Dallas | 166/379 |
| 6,817,423 | B2 * | 11/2004 | Dallas | 166/382 |
| 6,834,717 | B2 * | 12/2004 | Bland | 166/78.1 |
| 6,918,439 | B2 * | 7/2005 | Dallas | 166/85.3 |
| 2002/0062964 | A1 * | 5/2002 | Allen | 166/312 |
| 2003/0089502 | A1 * | 5/2003 | Dallas | 166/379 |
| 2003/0116314 | A1 | 6/2003 | Dallas | 166/249 |
| 2003/0192688 | A1 * | 10/2003 | Thomson et al. | 166/78.1 |
| 2003/0192698 | A1 | 10/2003 | Dallas | 166/307 |
| 2003/0221838 | A1 * | 12/2003 | Dallas | 166/373 |
| 2004/0173347 | A1 | 9/2004 | Dallas | 166/77.1 |

OTHER PUBLICATIONS

U.S. Appl. No. 10/440,795, entitled "Casing Mandrel with Well Stimulation Tool and Tubing Head Spool for Use with the Casing Mandrel," filed May 19, 2003.
U.S. Appl. No. 10/607,921, entitled "Multi-Lock Adapters for Independent Screwed Wellheads and Methods of Using Same," filed Jun. 27, 2003.
U.S. Appl. No. 10/656,693, entitled "Drilling Flange and Independent Screwed Wellhead with Metal-to-Metal Seal and Method of Use," filed Sep. 4, 2003.
U.S. Appl. No. 10/690,142, entitled "Metal Ring Gasket for a Threaded Union," filed Oct. 21, 2003.

* cited by examiner

*Primary Examiner*—David Bagnell
*Assistant Examiner*—Shane Bomar
(74) *Attorney, Agent, or Firm*—Nelson Mullins Riley & Scarborough, LLP

(57) ABSTRACT

A blast joint swivel for use in a wellhead isolation tool includes a blast joint hanger mounted to a top of the wellhead isolation tool and a swivel body rotatably received in the blast joint hanger. The swivel body threadedly connects to a blast joint, which in turn threadedly connects to a top end of a tubing string suspended in a well. The blast joint swivel can also be displaced vertically over a limited range between upper and lower abutments.

20 Claims, 3 Drawing Sheets

BLAST JOINT SWIVEL FOR WELLHEAD ISOLATION TOOL AND METHOD OF USING SAME

CROSS-REFERENCE TO RELATED APPLICATIONS

This is the first application filed for the present invention.

MICROFICHE APPENDIX

Not applicable.

FIELD OF THE INVENTION

The present invention relates to equipment for servicing oil and gas wells and, in particular, to a blast joint for a wellhead isolation tool used to isolate a wellhead from exposure to high-pressure, abrasive and corrosive fracturing fluids used to stimulate a well.

BACKGROUND OF THE INVENTION

Most oil and gas wells require stimulation to enhance hydrocarbon flow to make or keep them economically viable. The servicing of oil and gas wells to stimulate production requires the pumping of fluids into the well under high pressure. The fluids are generally corrosive and/or abrasive because they are laden with corrosive acids and/or abrasive proppants, such as sharp sand or bauxite.

In order to protect components that make up the wellhead, such as the valves, tubing hanger, casing hanger, casing head and/or blowout preventer equipment, wellhead isolation equipment, such as a wellhead isolation tool, a casing saver or a blowout preventer protector is used during well fracturing and well stimulation procedures. The wellhead isolation equipment may include a "blast joint" that is connected to a production tubing in the well used as a "dead string" to monitor downhole pressure during well stimulation and to flow back stimulation fluids after the well stimulation is complete, or as an additional fluid path for delivering high pressure stimulation fluids into the well.

As shown schematically in FIG. 1, a wellhead isolation tool 10 includes a sealing assembly 12, e.g. a "cup tool" or a high pressure fluid seal for a blowout preventer protector that seals off in a tubing spool above a bit guide. A blowout preventer protector equipped with a cup tool is described in U.S. Patent Application Publication 2003/0192698 (Dallas) entitled BLOWOUT PREVENTER PROTECTOR AND METHOD OF USING SAME which was published on Oct. 16, 2003 and which is hereby incorporated by reference. An example of a sealing assembly that seals off above a bit guide is described in U.S. Patent Application Publication 2003/0221838 (Dallas) entitled WELL STIMULATION TOOL AND METHOD OF USING SAME which was published on Dec. 4, 2003 and which is hereby incorporated by reference.

The wellhead isolation tool 10 further includes a blast joint 20 that has a threaded lower end 22 for connection to a threaded top end 32 of a tubing string 30 supported by slips 34 on a wellhead 40. The wellhead isolation tool 10 is lowered by a rig (not shown) into contact with the threaded top end 32 of the tubing string 30 and then the entire wellhead isolation tool 10 is rotated to connect the blast joint to the tubing string. As can be appreciated by those of ordinary skill in the art, connecting the blast joint to the tubing string in this way can be challenging. Precise control of the tool 10 must be exercised to ensure proper engagement of the threaded ends of the blast joint and the tubing string. If the tool 10 is a bit too high, the threads will not engage. If, however, the tool 10 is a bit too low the tool 10 will tilt as it is rotated and there is a real danger of cross-threading. The difficulty of connecting wellhead isolation equipment using this prior-art technique can therefore result in unwanted delays and/or equipment damage.

Accordingly, there remains a need for an improved apparatus and method for connecting a blast joint to a tubing string.

SUMMARY OF THE INVENTION

It is therefore an object of the invention to provide an apparatus and method that facilitates connection of a blast joint to a tubing string.

The invention therefore provides a blast joint swivel for use in a wellhead isolation tool, comprising: a blast joint hanger mounted to a top of the wellhead isolation tool; and a swivel body received within the blast joint hanger, the swivel body having an axial fluid passage with bottom threads for connection to a top end of a blast joint, the blast joint hanger supporting the swivel body for unconstrained axial rotation relative to the blast joint hanger.

The invention further provides a method of connecting a blast joint of a wellhead isolation tool to a tubing string suspended in a wellbore, the method comprising: mounting a blast joint swivel to a top end of a wellhead isolation tool and connecting the blast joint to a bottom end of the blast joint swivel; hoisting the wellhead isolation tool over a wellhead of the well and lowering the wellhead isolation tool until a threaded bottom end of a blast joint contacts a threaded upper end of the tubing string; and rotating the blast joint to threadedly connect the blast joint to the tubing string.

The invention further provides a wellhead isolation tool for isolating a wellhead from high pressure fluids used to stimulate a well, comprising: a fracturing head through which the high-pressure fluids can be pumped into the well; a blast joint hanger mounted to a top of the fracturing head, the fracturing head and blast joint hanger together defining a central passage in fluid communication with the side ports; a tubular swivel body received within the central bore for unconstrained rotational movement relative to the blast joint hanger; and a tubular blast joint connected to a bottom end of the swivel body, a bottom end of the blast joint being threaded for connection to a top end of a tubing string suspended in the well.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

In general, and as will be explained below, the invention provides a blast joint swivel for use with a wellhead isolation tool. The blast joint swivel includes a blast joint hanger mounted to a top of the wellhead isolation tool and a swivel body rotatably received in the blast joint hanger. The swivel body threadedly connects to a blast joint which, in turn, threadedly connects to a top end of a tubing string suspended in a well. In one embodiment the blast joint swivel can also be displaced vertically over a limited range of movement between upper and lower abutments to facilitate threading of the blast joint to the tubing string. The blast joint swivel facilitates connection of the wellhead isolation tool to the tubing string, which reduces wellhead isolation tool setup time.

Figure 1:
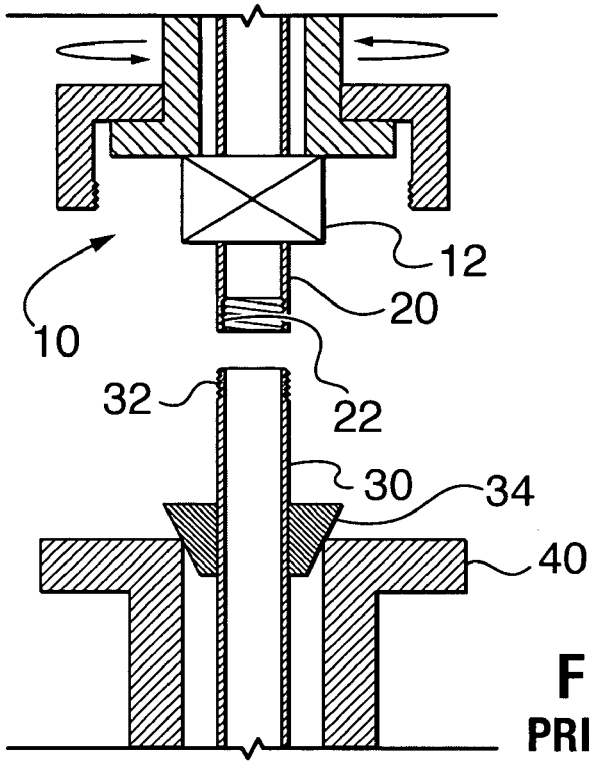
FIG. 1 PRIOR ART
FIG. 1 is a schematic cross-sectional view of a method of connecting a blast joint to a tubing string in accordance with the prior art.
Figure 2:
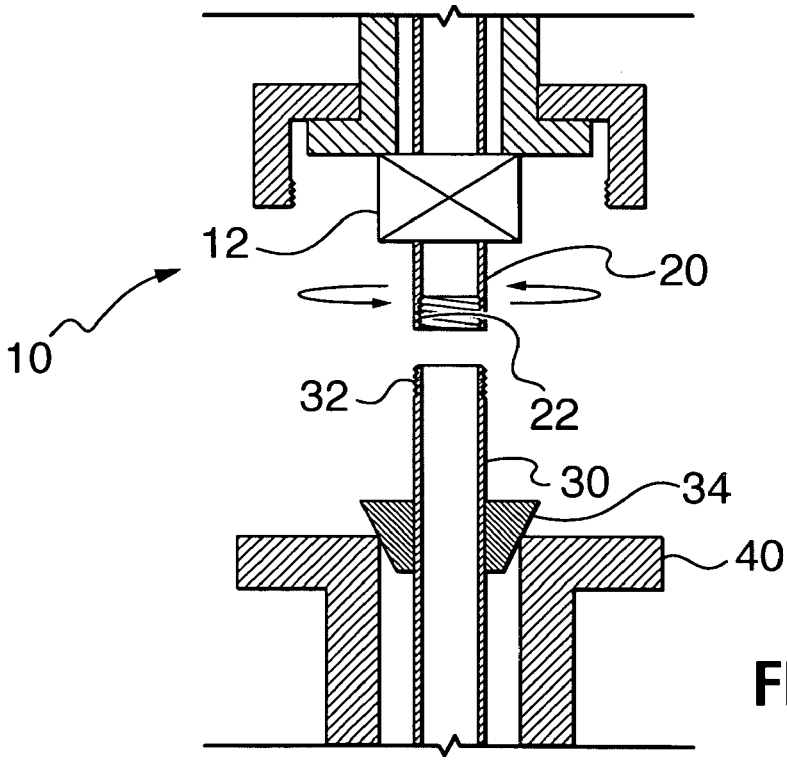
FIG. 2 is a schematic cross-sectional view of a method of connecting a blast joint to a tubing string in accordance with an embodiment of the invention.

As shown schematically in FIG. 2, a wellhead isolation tool 10 includes a sealing assembly 12, e.g. a "cup tool" or a high pressure fluid seal for a blowout preventer protector that seals off in a tubing spool above a bit guide. The wellhead isolation tool 10 also includes a blast joint 20 which has a threaded lower end 22 for connection to an upper threaded end 32 of a tubing string 30 supported by slips 34 on a wellhead 40. The blast joint 20 is rotatably received within a mandrel of the wellhead isolation tool 10, as will be described in greater detail below. As shown in FIG. 2, the blast joint 20 can be rotated relative to the wellhead isolation tool 10 so that the blast joint 20 can be threaded onto the tubing string 30 without having to rotate the entire wellhead isolation tool 10. By rotating the blast joint 20 in lieu of the entire wellhead isolation tool 10, the connection of the wellhead isolation tool 10 to the tubing string 30 is significantly easier.

Figure 3:
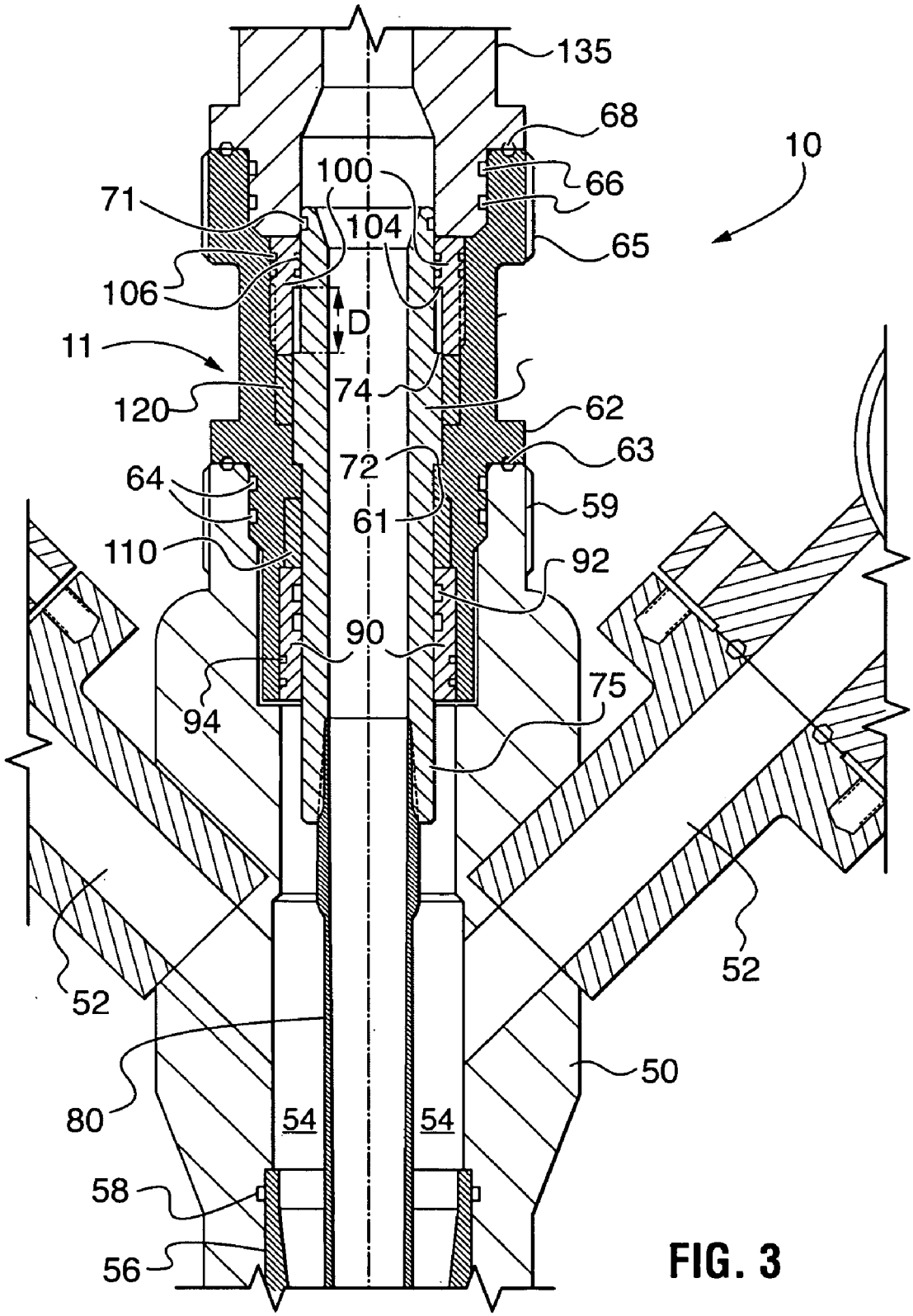
FIG. 3 is a partial cross-sectional view of a wellhead isolation tool with a blast joint swivel in accordance with an embodiment of the invention.

FIG. 3 is a partial cross-sectional view of a wellhead isolation tool 10 with a blast joint swivel 11 in accordance with an embodiment of the invention. As shown in FIG. 3, the wellhead isolation tool 10 includes a fracturing head 50. The fracturing head 50 includes angled side ports 52 through which high-pressure fracturing fluids (often laden with proppants) can be pumped in a manner well known in the art. The fracturing head 50 includes a generally tubular body defining an axial fluid passage (or central bore) 54 for conveying the fracturing fluids into the well. The fracturing head 50 can include a replaceable wear-resistant sleeve (or insert) 56 and an associated seal 58 which are provided to protect the fracturing head from the corrosive and/or abrasive fracturing fluids in order to prolong the longevity of the fracturing head.

The blast joint swivel 11 further includes a blast joint hanger 60 connected to a top of the fracturing head 50 by a threaded union, e.g. a hammer union (which is not shown, but which is well known in the art). The threads of the hammer union connect to the upper threads 59 of the fracturing head 50 to secure a lower flange 62 of the blast joint hanger 60 to the top of the fracturing head. Furthermore, the blast joint hanger 60 is sealed to the fracturing head 50 by a metal ring gasket 63 and a pair of backup annular sealing elements 64 (e.g. elastomeric seals such as rubber gaskets) which provide a fluid-tight seal between the blast joint hanger and the fracturing head. The metal ring gasket 63 is described in Applicant's co-pending U.S. patent application Ser. No. 10/690,142 (Dallas) entitled METAL RING GASKET FOR A THREADED UNION filed on Feb. 21, 2003.

Secured atop the blast joint hanger 60 is an adapter spool 135 to which is secured a high-pressure fluid flow control component in a manner well known in the art. In the embodiment illustrated in FIG. 3, the blast joint hanger 60 has upper threads 65 for connecting to another threaded union, e.g. a hammer union (not shown). The hammer union secures the adapter spool 135 to the top of the blast joint hanger 60. A metal ring gasket 68 and a pair of backup annular sealing elements 66 (e.g. rubber gaskets) provide a fluid-tight seal between the blast joint hanger 60 and the adapter spool 135.

As shown in FIG. 3, the blast joint hanger 60 rotatably receives a blast joint swivel 11, which can rotate in an unconstrained manner relative to the blast joint hanger 60. The blast joint swivel 11 has a swivel body 70 and a blast joint 80. The blast joint 80 is threadedly connected to a bottom end 75 of the swivel body 70. To facilitate rotation of the blast joint swivel, a pair of spaced-apart needle bearings (i.e. a lower needle bearing 110 and an upper needle bearing 120) are disposed between body 70 and the blast joint hanger 60. The lower needle bearing 110 is supported and restrained by a lower collar 90 which is threadedly connected to an inside of the blast joint hanger 60. The lower collar 90 includes a pair of inner annular seal grooves dimensioned to receive high-performance annular sealing elements 92 for providing a fluid-tight seal between the lower collar 90 and the swivel body 70. The high-performance annular sealing elements can be any one or more of quad seals, lip seals, or O-rings with backups. The seals can also be polypack or V-pack. These seals can be made of any one of a variety of high-performance sealing materials such as nitrile rubber, carbon rubber, polyurethane, Viton™ or Teflon™ having 50-100 durometer and, in some embodiments, 70-90 durometer. Another high-performance annular sealing element is seated in annular groove 71 at the top end of the swivel body 70. These seals inhibit penetration of corrosive and/or abrasive fracturing fluid into the blast joint swivel.

The lower collar 90 also includes a pair of outer annular seal grooves dimensioned to receive annular sealing elements 94, e.g. elastomeric O-rings, for providing a fluid-tight seal between the lower collar 90 and the blast joint hanger 60.

As further shown in FIG. 3, the blast joint swivel 11 can be displaced vertically relative to the blast joint hanger 60 over a limited range, facilitating the threading of the blast joint 80 onto the tubing string. The swivel body 70 includes a lower annular shoulder 72 supported, in an inoperative or unengaged position (i.e. before the blast joint contacts the tubing string), by a lower abutment 61 formed by an annular shoulder on the blast joint hanger 60. The lower abutment 61 limits downward displacement of the blast joint swivel 11 relative to the blast joint hanger 60. The swivel body 70 also includes an upper annular shoulder 74 which is spaced a vertical distance D beneath an upper abutment 104 formed by an annular shoulder in an upper collar 100. Therefore, the upper abutment and the lower abutment limit the vertical travel of the blast joint swivel relative to the blast joint hanger. The blast joint swivel can thus be displaced within a vertical range of the distance D. In one embodiment, the distance D is at least as great as the vertical displacement of the blast joint relative to the tubing string when the blast joint is threadedly connected to the tubing string.

The upper collar 100 is threadedly connected to an inside of the blast joint hanger 60 to restrain the upper needle bearing 120 between the upper collar 90 and the blast joint hanger 60. In one embodiment, the upper collar 100 has two inner annular seal grooves and two outer annular seal grooves for receiving annular sealing elements 106, e.g.

O-rings, which provide fluid-tight seals between the swivel body and the upper collar and between the upper collar and the blast joint hanger, respectively.

In operation, the wellhead isolation tool 10 is hoisted over the wellhead and lowered until the blast joint contacts the tubing string. Before the blast joint contacts the tubing string, the blast joint swivel is disposed in rest position. When the blast joint contacts the tubing string, the blast joint and swivel body are forced upwardly relative to the blast joint hanger as the wellhead isolation tool is lowered. This upward displacement is limited by the upper abutment 104 so that the maximum vertical travel of the swivel body is not more than the distance D. Once the swivel body has been displaced upwardly by a distance d where $d \leqq D$, the swivel body and blast joint are in an operative or engaged position. In the operative position, the blast joint can be threaded onto the tubing string. As the blast joint threads onto the tubing string, the swivel body is drawn downwards towards the rest position. Accordingly, the distance D should be at least as great as the vertical displacement of the blast joint relative to the tubing string when the blast joint is connected to the tubing string.

Figure 4:
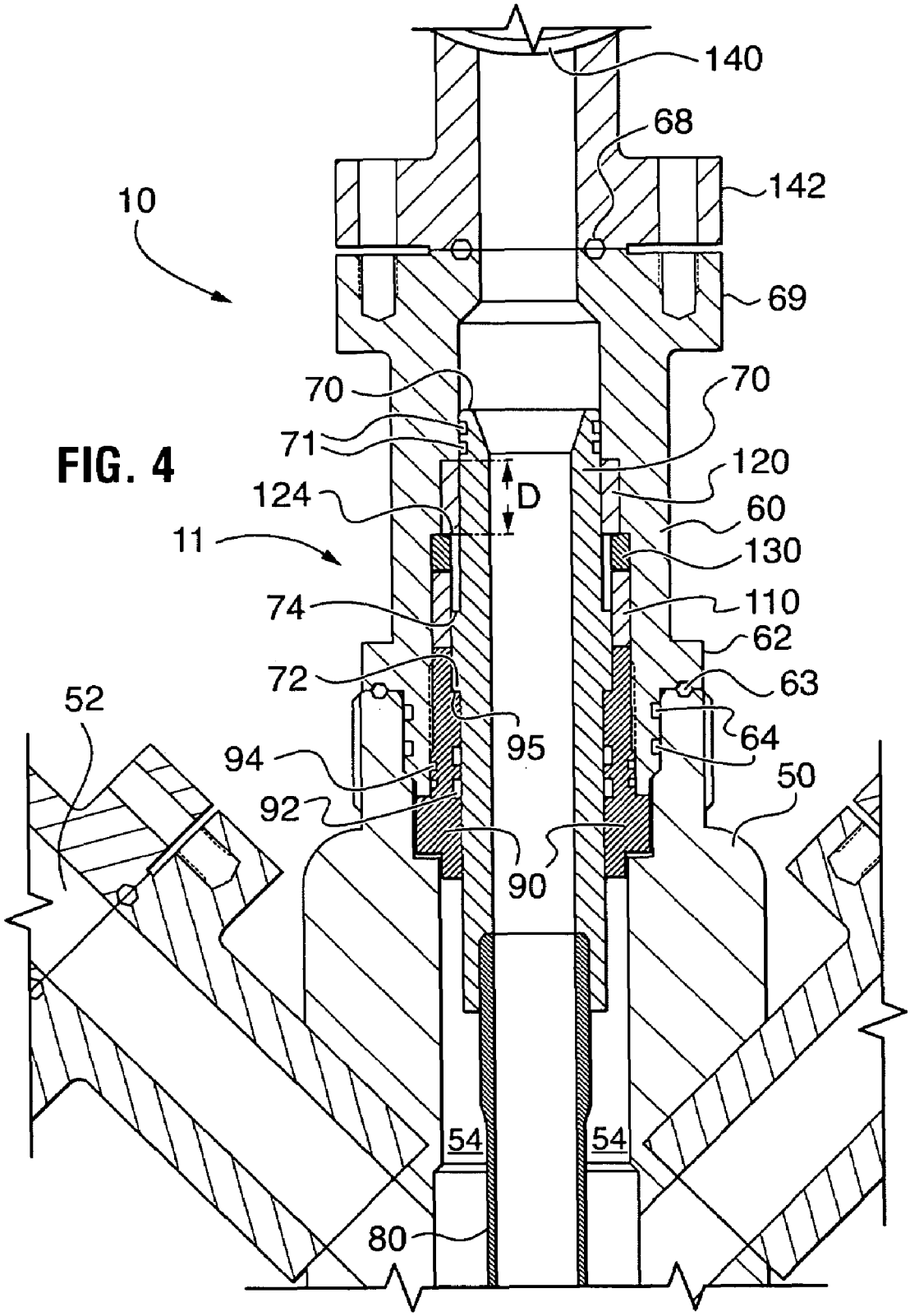
FIG. 4 is a partial cross-sectional view of another type of wellhead isolation tool with a blast joint swivel in accordance with another embodiment of the invention.

FIG. 4 is a partial cross-sectional view of a variant of the wellhead isolation tool 10 equipped with the blast joint swivel 11 in accordance with another embodiment of the invention. For the sake of clarity and brevity, same or similar components will not be redundantly described. In this embodiment, a high-pressure valve 140 having a lower flange 142 is bolted directly to an upper flange 69 of the blast joint hanger 60.

The blast joint swivel 11 includes a swivel body 70 rotatably received within the axial passage (or central bore) of the blast joint hanger. In other words, the swivel body and blast joint are free to rotate relative to the blast joint hanger and fracturing head. A lower needle bearing 110 and an upper needle bearing 130 are disposed between the swivel body and the blast joint hanger to facilitate smooth rotation of the swivel body.

As shown in FIG. 4, a pair of high-performance annular sealing elements are seated in respective annular seal grooves 71 in the top end of the swivel body. Likewise, another pair of high-performance annular sealing elements are seated in annular seal grooves 92 in a lower collar 90. These high-performance annular sealing elements inhibit penetration of corrosive and/or abrasive fracturing fluid into the blast joint swivel.

The lower collar 90 supports and restrains the first needle bearing 110 as well as a steel spacer ring 130 disposed above the first needle bearing 110. The spacer ring 130 is pressed upwardly into partial abutment with an annular shoulder of the blast joint hanger. The spacer ring 130 also supports a second needle bearing 120, restraining the second needle bearing 120 between the spacer ring 130 and another annular shoulder of the blast joint hanger. The swivel body can thus be displaced the limited distance D between the lower abutment defined by an annular shoulder 95 of the lower collar 90 and an upper abutment 124 defined by a bottom surface of the second needle bearing 120.

The swivel body and blast joint can also be vertically displaced relative to the blast joint hanger but only over a limited range as was described above with respect to the previous embodiment. Vertical displacement of the swivel body and blast joint relative to the blast joint hanger is limited by a lower abutment and an upper abutment. In one embodiment, as shown in FIG. 4, the swivel body includes a lower annular shoulder 72 which, in a rest position, abuts a lower abutment 95 formed by an annular shoulder of the lower collar 90. The swivel body also includes an upper annular shoulder 74 which is spaced the distance D (again in the rest position) beneath an upper abutment 124 formed by a bottom surface of the upper needle bearing 120. When the blast joint is lowered into contact with the tubing string, the swivel body and blast joint are displaced upwardly (by up to a distance D) as the wellhead isolation tool is lowered. Once the wellhead isolation tool 10 has been lowered, the blast joint can begin to be threaded onto the tubing string. As the blast joint is threaded onto the tubing string, the swivel body and blast joint move back down toward the rest position. Accordingly, as was explained above, the upper and lower abutments should be spaced apart by the vertical distance D, which is at least as great as the vertical displacement of the blast joint relative to the tubing string when the blast joint threads onto the tubing string.

Modifications and improvements to the above-described embodiments of the present invention may become apparent to those skilled in the art. The foregoing description is intended to be exemplary rather than limiting. The scope of the invention is therefore intended to be limited solely by the scope of the appended claims.

We claim:

1. A blast joint swivel, comprising:

a blast joint hanger; and a swivel body rotatably supported within a central bore of the blast joint hanger, the swivel body defining an axial fluid passage with bottom threads for connection to a top end of a blast joint, the blast joint hanger supporting the swivel body for unconstrained axial rotation relative to the blast joint hanger; and upper and lower abutments in the central bore of the blast joint hanger between which the swivel body is vertically displaceable without rotation of the swivel body or the blast joint hanger, the vertical displacement of the swivel body being at least equivalent to a vertical displacement of the blast joint when the blast joint is threadedly connected to a top of a tubing string supported in a well.

2. The blast joint swivel as claimed in claim 1 wherein the swivel body further comprises a lower annular shoulder that contacts the lower abutment and an upper annular shoulder that contacts the upper abutment to respectively limit the vertical displacement of the swivel body relative to the blast joint hanger.

3. The blast joint swivel as claimed in claim 1 wherein the upper abutment is formed by a bottom surface of a bearing in the central bore of the blast joint hanger and the lower abutment is formed by an annular shoulder of a collar threadedly connected to a bottom end of the blast joint hanger.

4. The blast joint swivel as claimed in claim 1 wherein the upper abutment is formed by an annular shoulder of a collar threadedly connected to a top end of the blast joint hanger and the lower abutment is formed by an annular shoulder in the central passage of the blast joint hanger.

5. The blast joint swivel as claimed in claim 1 wherein the blast joint hanger further comprises one of a stud pad and a flange to permit a high pressure fluid flow control component to be mounted thereto.

6. The blast joint swivel as claimed in claim 1 wherein the blast joint hanger further comprises a threaded top end to which an adapter spool is mounted, the adapter spool having a top end comprising one of a stud pad and a flange to permit a high pressure fluid flow control component to be mounted thereto.

7. The blast joint swivel as claimed in claim 1 wherein the blast joint hanger comprises:

a first collar threadedly received in a top end of the central bore, the first collar including an annular shoulder providing the upper abutment and retaining an upper bearing for supporting the swivel body for rotation;

a second collar threadedly received in a bottom end of the central bore, the second collar retaining a lower bearing for supporting the swivel body for rotation; and an annular shoulder in the central bore, the annular shoulder providing a spacer between the upper and lower bearings, and further providing the lower abutment.

8. The blast joint swivel as claimed in claim 7 wherein each of the first and second collars include seal grooves in an inner surface that faces an outer surface of the swivel body, the seal grooves receiving seals for inhibiting a migration of high pressure fluids to the bearings.

9. The blast joint swivel as claimed in claim 7 wherein the upper bearing and the lower bearing respectively comprise a needle bearing.

10. The blast joint swivel as claimed in claim 1 wherein the blast joint hanger comprises:

a collar threadedly received in a bottom end of the central bore, the collar including an annular shoulder providing the lower abutment and retaining a lower bearing for supporting the swivel body for rotation; and a spacer ring above the lower bearing, the spacer ring retaining an upper bearing for supporting the swivel body for rotation, a bottom race of the upper bearing providing the upper abutment.

11. The blast joint swivel as claimed in claim 10 wherein an inner surface of the collar and an outer surface of a top end of the swivel body include seal grooves, the seal grooves receiving seals for inhibiting a migration of high pressure fluids to the upper and lower bearings.

12. A method of connecting a blast joint of a wellhead isolation tool to a tubing string suspended in a wellbore, the method comprising:

mounting a blast joint swivel to a top end of a wellhead isolation tool and connecting the blast joint to a bottom end of a swivel body supported within the blast joint swivel for unconstrained rotation;

hoisting the wellhead isolation tool over a wellhead of the well and lowering the wellhead isolation tool until a threaded bottom end of the blast joint contacts a threaded upper end of the tubing string and the swivel body is vertically displaced within the blast joint swivel until the swivel body abuts an upper abutment within the blast joint swivel; and rotating the blast joint to threadedly connect the blast joint to the tubing string without further vertically displacing the wellhead isolation tool.

13. A blast joint swivel, comprising:

a blast joint hanger having a central bore, a top end adapted for the connection of an adapter flange or a fluid flow control component, and a bottom end adapted to be mounted to a fracturing head through which high-pressure fluids can be pumped into a well;

a swivel body received within the central bore of the blast joint hanger for unconstrained rotational movement relative to the blast joint hanger and vertical displacement without rotation between upper and lower abutments within the central bore; and a tubular blast joint connected to a bottom end of the swivel body, a bottom end of the tubular blast joint being threaded for connection to a top end of the tubing string suspended in the well.

14. The blast joint swivel as claimed in claim 13, further comprising:

a lower annular shoulder supported by the lower abutment restraining downward displacement of the swivel body relative to the blast joint hanger; and an upper annular shoulder spaced beneath the upper abutment, thereby limiting the vertical displacement of the swivel body relative to the blast joint hanger;

whereby the blast joint can be vertically displaced without rotation at least a length of a threaded connection between the blast joint and a tubing string supported in the well.

15. The blast joint swivel as claimed in claim 14 wherein the vertical displacement of the tubular swivel body relative to the blast joint hanger is greater than the length of the threaded connection between the blast joint and the tubing string.

16. The blast joint swivel as claimed in claim 13 wherein the lower abutment is formed by an annular shoulder of the blast joint hanger.

17. The blast joint swivel as claimed in claim 13 wherein the lower abutment is formed by an annular shoulder of a collar threadedly connected to the blast joint hanger.

18. The blast joint swivel as claimed in claim 13 wherein the upper abutment is formed by an annular shoulder of a collar threadedly connected to the blast joint hanger.

19. The blast joint swivel as claimed in claim 13 further comprising at least one bearing disposed between the tubular swivel body and the blast joint hanger to facilitate rotation of the tubular swivel body relative to the blast joint hanger.

20. The blast joint swivel as claimed in claim 19 wherein the at least one bearing is a needle bearing.

* * * * *

UNITED STATES PATENT AND TRADEMARK OFFICE

CERTIFICATE OF CORRECTION

PATENT NO. : 7,278,490 B2
APPLICATION NO. : 11/025453
DATED : October 9, 2007
INVENTOR(S) : Bob McGuire and L. Murray Dallas It is certified that error appears in the above-identified patent and that said Letters Patent is hereby corrected as shown below:

The title page showing the illustrative figure should be deleted to be replaced with the attached title page.

In the Drawings:
The drawing sheet, consisting of Fig. 3, should be deleted to be replaced with the drawing sheets, consisting of Fig. 3, as shown below.

Please replace Sheet 2 of 3 (Figure 3), which includes additional reference numbers 60 and 70.

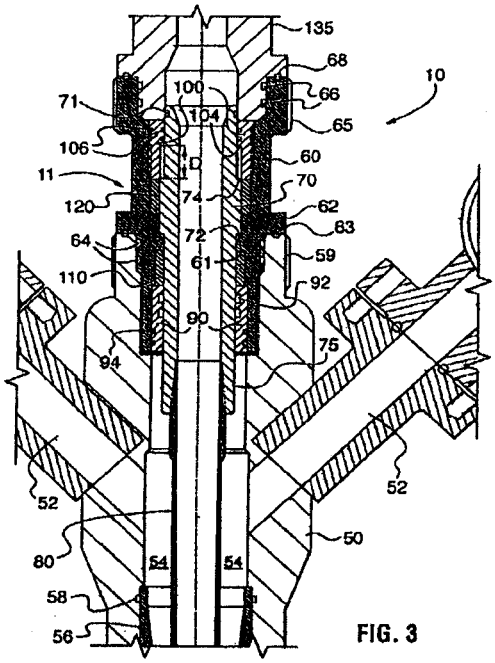

FIG. 3

In column 5, line 14, please delete "d≦D" and replace with --d ≤ D--.

Signed and Sealed this

Twenty-third Day of March, 2010

David J. Kappos

David J. Kappos
*Director of the United States Patent and Trademark Office*

(12) United States Patent
McGuire et al.

(10) Patent No.: US 7,278,490 B2
(45) Date of Patent: Oct. 9, 2007

(54) BLAST JOINT SWIVEL FOR WELLHEAD ISOLATION TOOL AND METHOD OF USING SAME

(75) Inventors: Bob McGuire, Oklahoma City, OK (US); L. Murray Dallas, Fairview, TX (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 264 days.

(21) Appl. No.: 11/025,453

(22) Filed: Dec. 28, 2004

(65) Prior Publication Data

US 2006/0137882 A1 Jun. 29, 2006

(51) Int. Cl.
*E21B 19/16* (2006.01)
*E21B 33/04* (2006.01)

(52) U.S. Cl. ..... 166/379; 166/382; 166/85.1; 166/75.14; 166/75.13

(58) Field of Classification Search ..... 166/379, 166/382, 85.1, 85.4, 85.5, 90.1, 92.1, 94.1, 166/75.13, 75.14
See application file for complete search history.

(56) References Cited

U.S. PATENT DOCUMENTS

| | | | | | |
|---|---|---|---|---|---|
| 2,660,248 | A * | 11/1953 | Brown | 166/78.1 |
| 4,915,177 | A * | 4/1990 | Claycomb | 166/380 |
| 5,012,865 | A * | 5/1991 | McLeod | 166/90.1 |
| 5,275,441 | A * | 1/1994 | Claycomb | 285/45 |
| 5,540,282 | A | 7/1996 | Dallas | 166/379 |
| 5,785,121 | A * | 7/1998 | Dallas | 166/90.1 |
| 5,819,851 | A | 10/1998 | Dallas | 166/308 |
| 5,957,198 | A | 9/1999 | Haynes | 166/250.03 |
| 6,019,175 | A * | 2/2000 | Haynes | 166/382 |
| 6,220,363 | B1 | 4/2001 | Dallas | 166/382 |
| 6,289,993 | B1 | 9/2001 | Dallas | 166/386 |
| 6,364,024 | B1 * | 4/2002 | Dallas | 166/379 |
| 6,447,021 | B1 | 9/2002 | Haynes | 285/302 |
| 6,626,245 | B1 * | 9/2003 | Dallas | 166/379 |
| 6,712,147 | B2 * | 3/2004 | Dallas | 166/379 |
| 6,817,423 | B2 * | 11/2004 | Dallas | 166/382 |
| 6,834,717 | B2 * | 12/2004 | Bland | 166/78.1 |
| 6,918,439 | B2 * | 7/2005 | Dallas | 166/85.3 |
| 2002/0062964 | A1 * | 5/2002 | Allen | 166/312 |
| 2003/0089502 | A1 * | 5/2003 | Dallas | 166/379 |
| 2003/0116314 | A1 | 6/2003 | Dallas | 166/249 |
| 2003/0192688 | A1 * | 10/2003 | Thomson et al. | 166/78.1 |
| 2003/0192698 | A1 | 10/2003 | Dallas | 166/307 |
| 2003/0221838 | A1 * | 12/2003 | Dallas | 166/373 |
| 2004/0173347 | A1 | 9/2004 | Dallas | 166/77.1 |

OTHER PUBLICATIONS

U.S. Appl. No. 10/440,795, entitled "Casing Mandrel with Well Stimulation Tool and Tubing Head Spool for Use with the Casing Mandrel," filed May 19, 2003.
U.S. Appl. No. 10/607,921, entitled "Multi-Lock Adapters for Independent Screwed Wellheads and Methods of Using Same," filed Jun. 27, 2003.
U.S. Appl. No. 10/656,693, entitled "Drilling Flange and Independent Screwed Wellhead with Metal-to-Metal Seal and Method of Use," filed Sep. 4, 2003.
U.S. Appl. No. 10/690,142, entitled "Metal Ring Gasket for a Threaded Union," filed Oct. 21, 2003.

* cited by examiner

*Primary Examiner*—David Bagnell
*Assistant Examiner*—Shane Bomar
(74) *Attorney, Agent, or Firm* Nelson Mullins Riley & Scarborough, LLP

(57) ABSTRACT

A blast joint swivel for use in a wellhead isolation tool includes a blast joint hanger mounted to a top of the wellhead isolation tool and a swivel body rotatably received in the blast joint hanger. The swivel body threadedly connects to a blast joint, which in turn threadedly connects to a top end of a tubing string suspended in a well. The blast joint swivel can also be displaced vertically over a limited range between upper and lower abutments.

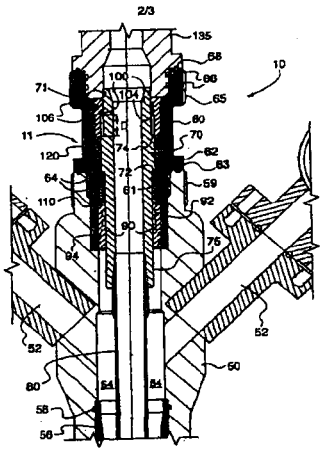

20 Claims, 3 Drawing Sheets